US011242628B2

(12) United States Patent
Mueller et al.

(10) Patent No.: US 11,242,628 B2
(45) Date of Patent: Feb. 8, 2022

(54) SPACER FABRIC

(71) Applicants: Stefan Mueller, Wiehl (DE); Joachim Weis, Rauschenberg (DE)

(72) Inventors: Stefan Mueller, Wiehl (DE); Joachim Weis, Rauschenberg (DE)

(73) Assignee: MUELLER TEXTIL GMBH, Wiehl-Drabenderhoehe (DE)

( * ) Notice: Subject to any disclaimer, the term of this patent is extended or adjusted under 35 U.S.C. 154(b) by 249 days.

(21) Appl. No.: 16/543,793

(22) Filed: Aug. 19, 2019

(65) Prior Publication Data

US 2020/0077539 A1 Mar. 5, 2020

(30) Foreign Application Priority Data

Aug. 28, 2018 (DE) ..... 102018120999.1

(51) Int. Cl.

| | |
|---|---|
| ***D04B 21/20*** | (2006.01) |
| ***D04B 1/16*** | (2006.01) |
| ***D04B 1/22*** | (2006.01) |
| ***D04B 21/16*** | (2006.01) |
| *D04C 1/02* | (2006.01) |
| *D04B 27/22* | (2006.01) |

(52) U.S. Cl.

CPC ..... *D04B 21/20* (2013.01); *D04B 1/16* (2013.01); *D04B 1/22* (2013.01); *D04B 21/16* (2013.01); *D04B 27/22* (2013.01); *D04C 1/02* (2013.01)

(58) Field of Classification Search

CPC . D04B 1/16; D04B 1/22; D04B 21/16; D04B 21/20; D04B 27/22

See application file for complete search history.

(56) References Cited

U.S. PATENT DOCUMENTS

| | | | | |
|---|---|---|---|---|
| 3,562,082 | A * | 2/1971 | Van Buskirk | H05B 3/342 428/222 |
| 6,780,280 | B2 * | 8/2004 | Halterbeck | B32B 5/08 156/583.3 |
| 2003/0059576 | A1 * | 3/2003 | Halterbeck | D03D 15/513 428/159 |
| 2003/0090200 | A1 * | 5/2003 | Topelberg | H05B 33/26 313/511 |
| 2005/0235482 | A1 * | 10/2005 | Deaett | H01P 11/00 29/600 |
| 2013/0320076 | A1 * | 12/2013 | Katschke | B65D 27/00 229/307 |
| 2017/0071032 | A1 * | 3/2017 | Mueller | H05B 3/345 |
| 2020/0002855 | A1 * | 1/2020 | Aristizabal | D04B 1/12 |
| 2020/0032428 | A1 * | 1/2020 | Mueller | D02G 3/12 |
| 2020/0077539 | A1 * | 3/2020 | Mueller | D04B 21/16 |

(Continued)

FOREIGN PATENT DOCUMENTS

| | | | |
|---|---|---|---|
| DE | 9016062 | U | 3/1991 |
| DE | 19903070 | A | 8/2000 |

(Continued)

*Primary Examiner* — Danny Worrell

(74) *Attorney, Agent, or Firm* — Andrew Wilford

(57) ABSTRACT

A knitted spacer fabric has two transversely spaced knitted layers and first and second spacer yarns extending transversely between and connecting the knitted layers. Both knitted layers are formed by metal braid that is arranged such that laminar electrical and thermal conduction is provided by the metal braid in both knitted layers, and the first spacer yarns are also formed by metal braid.

17 Claims, 2 Drawing Sheets

(56) References Cited

U.S. PATENT DOCUMENTS

| | | | | |
|---|---|---|---|---|
| 2020/0199790 | A1* | 6/2020 | Hayashi | D02G 3/36 |
| 2020/0240055 | A1* | 7/2020 | Mueller | D04B 21/20 |
| 2020/0263334 | A1* | 8/2020 | Mueller | D04B 21/14 |

FOREIGN PATENT DOCUMENTS

| | | | |
|---|---|---|---|
| DE | 102006038611 | A | 2/2008 |
| DE | 102006038612 | A | 2/2008 |
| DE | 102008034937 | A | 2/2010 |
| DE | 102009013250 | A | 7/2010 |
| DE | 102015114778 | A | 3/2017 |

* cited by examiner

SPACER FABRIC

FIELD OF THE INVENTION

The present invention relates to a spacer fabric. More particularly this invention concerns such a fabric used to conduct heat.

BACKGROUND OF THE INVENTION

A knitted spacer fabric is known having two knitted layers and spacer yarns that transversely connect the knitted layers. One of the knitted layers may be made at least partially of metal braid and at least a portion of the spacer yarns may also be formed by metal braid.

Knitted spacer fabrics are characterized by a light, air-permeable structure and generally have considerable elasticity in the transverse direction of their thickness as a result of spacer yarns that run transversely between the planes of the two knitted layers. By virtue of these properties, knitted spacer fabrics are often provided as soft, elastic layers that enable air circulation in mattresses, upholstered furniture, garments, or shoes. A conventional knitted spacer fabric is known from DE 90 16 062.

In addition to such conventional applications in the consumer sector, knitted spacer fabrics are frequently also used as technical textiles for highly specialized applications. For instance, knitted spacer fabrics are also used in the automotive industry, for example for climate-controlled seats under the seat covers where the knitted spacer fabrics allow for good contour adjustment due to their cushioning properties and very good restorative behavior despite the overall low weight per unit area.

Another known application is the provision of a heating or sensor function, for which purpose wires and, in particular, braided metal wires are incorporated into the textile structure. Corresponding configurations are known from DE 19 903 070 A1, DE 10 2008 034 937, DE 10 2006 038 611, and DE 10 2009 013 250.

According to DE 10 2015 114 778, a knitted spacer fabric is proposed for heating purposes in which conductive yarns of a flat knitted layer are formed from a plastic monofilament yarn that is provided with a conductive coating. The monofilament yarn has the advantage that, despite the conductive and, in particular, metallic coating of the individual filaments, it is still is relatively flexible, thus enabling processing in a knitting process. The conductive yarns are arranged in one of the two flat knitted layers that is usually facing the user.

Finally, a knitted spacer fabric of this type is known from DE 10 2006 038 612. This spacer fabric is also intended for use as a seat heating element, it being possible for a knitted layer to be composed entirely of metal braid as conductive yarns. Optionally, a portion of the spacer yarns can also be formed by metal braid, but in that case the spacer yarns are preferably provided with insulation.

The knitted spacer fabric that is provided as a seat heating element has not come to be widely used in practice. In order to achieve the desired heating effect for resistance heating, the specific resistance is too low precisely in a configuration with a knitted layer that is composed entirely of metal braid, resulting in non-negligible, undesirable energy and heat losses in the leads and at the contact points. Moreover, due to its high metal content, the material is very expensive and not economically competitive compared to other spacer fabrics for seat heaters that were also mentioned above that contain only a proportion of metallic yarns and/or coated plastic yarns.

OBJECTS OF THE INVENTION

It is therefore an object of the present invention to provide an improved spacer fabric.

Another object is the provision of such an improved spacer fabric that overcomes the above-given disadvantages, in particular that has an extended range of uses and benefits.

SUMMARY OF THE INVENTION

A knitted spacer fabric has two transversely spaced knitted layers each formed at least partially by metal braid and first spacer yarns extending transversely between and connecting the knitted layers and formed by metal braid such that laminar and transverse electrical and thermal conduction is provided by the metal braid of the knitted layers and of the spacer yarns.

Thus according to the invention a knitted spacer fabric of this generic type that is intended only for seat heaters for electrical resistance heating is modified in that both knitted layers have metal braid that is arranged such that laminar electrical and thermal conduction is provided by the metal braid on both knitted layers. These knitted layers are connected in an electrically and thermally conductive manner with spacer yarns at least partially formed by metal braid.

While heating of the knitted layer facing away from a user is not expedient in the case of a knitted spacer fabric that is provided for a seat heater and, in the case of a conductive configuration, would reduce the already insufficient resistance even further, the primary focus in the context of the present invention is on optimal electrical and thermal conductivity, particularly including in the transverse direction of thickness. Unlike with a resistance heater, the knitted spacer fabric is to have resistance that is as low as possible for thermal and/or electrical conduction in the framework of the invention.

According to the invention, the metal braid is arranged in the knitted layers such that laminar electrical and thermal conduction results from direct metallic contact. What is meant by this is that electrical and thermal conduction by direct metal contact is possible between any two points of the knitted layers at which the metal braid is present. Such conduction is thus possible along a production direction, a transverse direction, and also at any angle relative thereto in the knitted layers, which can also be assumed to be flat or substantially flat in this context. As will readily be understood, the metal braid is processed like a standard yarn, so that, as is usual with knitted fabrics, openings and gaps remain at the individual stitches where of course no heat or electrical current is transmitted through direct contact. Viewed in a simplified manner, the metal braid in the two knitted layers is arranged at least such that a kind of mesh or net is formed on the corresponding plane.

Especially preferably, the two knitted layers are composed entirely of metal braid. The use of metal braid formed by a plurality of strands, makes it possible to produce a knitted spacer fabric through formation of stitches, whereas strands having the same cross section as the metal braid cannot be processed in the knitting process, or at least not economically because of the stiffness of such thick solid metal filaments.

Since the two knitted layers and the spacer yarns are composed at least partially of metal braids, the overall result is a very high metal content of usually at least 70% by weight and preferably at least 80% by weight. The weight per unit area is typically between 0.25 kg/m$^2$ (kilograms per square meter) and 2.5 kg/m$^2$. In particular, the weight per unit area can be between 1 kg/m$^2$ and 2 kg/m$^2$, for example about 1.8 kg/m$^2$. The high metal content of up to 100% and the high weight per unit area also result in comparatively high production costs.

With a view to good heat conduction and/or electrical conductivity, copper or a copper alloy can be the material for the metal braid. Copper alloys are alloys with copper as the main constituent and other metals or semimetals in different mixing ratios. Known copper alloys include bronze (copper-tin) and brass (copper-zinc), for example. In contrast to pure or largely pure copper, copper alloys generally have lower conductivity. However, particularly for forming particularly thin wires for the metal braid that is provided according to the invention, copper alloys can be expedient. For better readability, only the term "copper" is used below, but it is always intended to also mean copper alloys. The properties and advantages described below in relation to copper itself usually also apply, at least to a certain extent, to the customary copper alloys.

According to an especially preferred embodiment of the invention, the metal braid is formed by appropriately individual tinned copper wires. Copper is characterized by very good thermal and electrical conductivity and is inexpensive compared to more noble metals such as silver and gold. If the strands of the metal braid are also tin plated, good protection also exists against corrosion. Moreover, as will be described in detail below, the metal braid can then also be soldered in a particularly simple manner.

According to a preferred embodiment of the invention, each of the two knitted layers on the one hand and the spacer yarns on the other hand are formed by two needle bars. In the context of such an embodiment, the metal braid is then processed at least on five needle bars, two for each outer layer and at least one for the spacer yarns.

According to another aspect of the invention, the first spacer yarns are preferably formed by metal braid and second spacer yarns are provided that are formed by polymeric monofilament yarn in order to achieve desired restoring characteristics. While the metal braid, used in the first spacer yarns produces no or little restorative elasticity under a compressive load, the typical behavior of an elasticity in the direction of thickness that is typical of a knitted spacer fabric can be achieved by use of the polymeric monofilament yarn as the second spacer yarns. Production is especially simple if the monofilament yarn on the one hand and the metal braid on the other hand are processed on different needle bars, so that the respective needle bars are then loaded completely with either the monofilament or the metal braid, requiring six needle bars to make the spacer yarn according to the invention.

In such an embodiment, the ratio of the density of the spacer yarns formed by metal braid to the density of the spacer yarns formed by monofilament yarn is 1:1. What is meant here is not the material density of the metal and of the plastic, but rather the density of the spacer yarns, i.e. the number of spacer yarns relative to a specified unit of area. In other words there are the same number of second yarns as first yarns.

In principle, however, other density ratios are also possible, between 3:1 and 1:3, for example, for which purpose either additional needle bars can be used on which yarns are omitted on the individual needle bars and/or different yarns are fed to the needle bars.

The monofilament yarns can preferably have a diameter of between 50 μm and 300 μm. Polyester and, in particular, polyethylene terephthalate (PET) is suitable as the material, but other materials such as polyamide can also be considered.

According to the invention, the spacer yarns formed by metal braids are electrically and thermally connected to the two knitted layers that are preferably made entirely of metal braid. Since the individual yarns or strands of metal braid are intertwined with one another by the knitting process, it is sufficient if these are bare and uninsulated so that the electrical and thermal contact is achieved by the mutual extensive contact alone.

Each metal braid typically has between 5 and 15 strands or filaments, each with a diameter of between 15 μm and 100 μm.

As will be described below, the knitted spacer fabric is particularly suitable for used as a heat-conducting layer for heat dissipation and, in particular, is connected to an electrical component. Both the open structure and the compressibility of the spacer knit can then be used in a particularly advantageous manner for transferring and removing heat.

The thickness of the knitted spacer fabric is typically between 2 mm and 20 mm, but larger thicknesses can also be readily achieved particularly when the knitted spacer fabric is used as a heat sink.

The invention also relates to the use of the above-described knitted spacer fabric as a heat conduction layer that is connected to an electrical component for heat dissipation. The knitted spacer fabric is usually mounted in extensive surface contact to one of the knitted layers on the electrical component to be cooled, in which case the knitted spacer fabric either rests only on the electrical component to be cooled or is preferably connected integrally to the electrical component. A connecting means can be provided for the integral connection, in which case a conventional heat-conducting adhesive or, with a view to good heat conduction, preferably thermal paste or solder (plumber's solder) are suitable. Good electrical contact is also achieved when a metallic solder is used, although electrically conductive compounds and electrically conductive adhesives and pastes are also known.

According to a preferred development of such a use, if the knitted spacer fabric is connected to an electrical component for heat dissipation, the knitted spacer fabric can be fitted in a thermally conductive manner, for example, tightly in a gap between a housing and the electrical component, thus bridging the gap. The knitted spacer fabric can then be used in this way to compensate for manufacturing tolerances and to allow for optimal cooling of the electrical component via the surrounding housing.

According to an alternative development of the use according to the invention, the knitted spacer fabric is connected as a heat sink to an electronic component as an electrical component. Conventional heatsinks for electronic components are usually embodied as milled or injection-molded parts, with the largest possible surface being provided by cooling fins. With the knitted spacer fabric according to the invention, when used as a heat sink, a particularly large surface area can be achieved with a comparatively low weight, with the flowability with a fluid flow, particularly air flow, also being improved. When used as a heat sink of an electrical component, the knitted spacer fabric according to the invention can contribute to a reduction in both weight and cost.

Especially good cooling, that is, heat exchange with the environment, can be achieved when air is pumped through the knitted spacer fabric. The knitted spacer fabric can thus be blown on by a fan or appropriately positioned in an air flow. In addition, it is also possible to connect a fan to the knitted spacer fabric that is then even shock-damped to some extent by the elastically resilient properties of the knitted spacer fabric. Particularly under harsh operating conditions, the lifetime of such a fan can thus be substantially extended.

As was already explained above, a particularly reliable and highly conductive connection can be achieved by soldering, especially when a metal braid is used that is formed by individual tinned wires. It can then even be accepted in many cases if the polymeric monofilament yarns are at least partially melted and destroyed under such a thermal load. If only individual subregions are soldered and exposed to a high thermal load, the monofilament yarns remain intact at least in the other areas and can also continue to ensure the elastic properties there. In the case of laminar or full-surface destruction of the monofilament yarns as a result of soldering or temperature input from another source, the polymeric monofilament yarns act as a kind of transport safety device or assembly aid at least until soldering.

In addition to the preferred use as a heat conduction layer that is connected to an electrical component for heat dissipation, other applications are also possible. For example, the good electrical conductivity of the knitted spacer fabric can also be exploited, in which case, unlike with resistance heating, there should actually be no losses at the knitted spacer fabric itself. The knitted spacer fabric can be provided, for example, as an elastic and flexible electrical contact layer. In addition, it may also be desirable to use the knitted spacer fabric for grounding and/or shielding.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
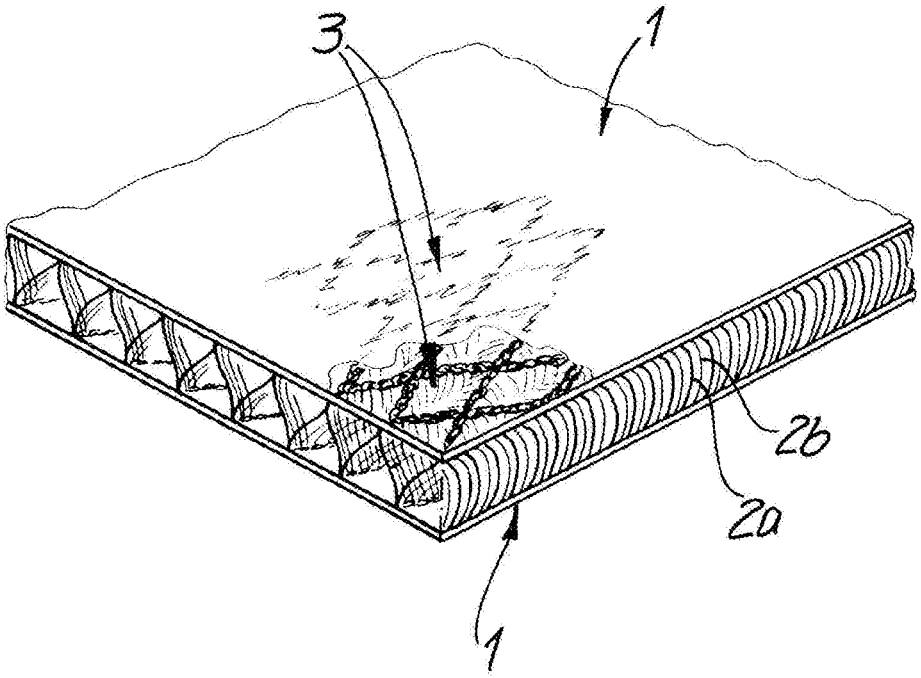
FIG. 1 is a perspective view of a piece of the spacer fabric according to the invention.

As seen in FIG. 1, a knitted spacer fabric has two knitted and generally planar or flat outer layers 1 and first and second spacer yarns 2*a* and 2*b* that extend transversely between and interconnect the knitted layers 1. Both knitted layers 1 and the first spacer yarns 2*a* are formed wholly of metal braid. This results in a three-dimensional, thermally and electrically highly conductive structure whose conductivity is ensured in the plane of the two knitted layers 1 and transversely by the first spacer yarns 2*a* in the direction of knit's thickness. The thermally and electrically conductive connection of the first spacer yarns 2*a* to the knitted layers 1 is achieved by using uncoated and uninsulated strands in the metal braid of the layers 1 and yarns 2*a* by having the yarns or strands of the metal braid angled as a result of stitching abut against one another.

Figure 2:
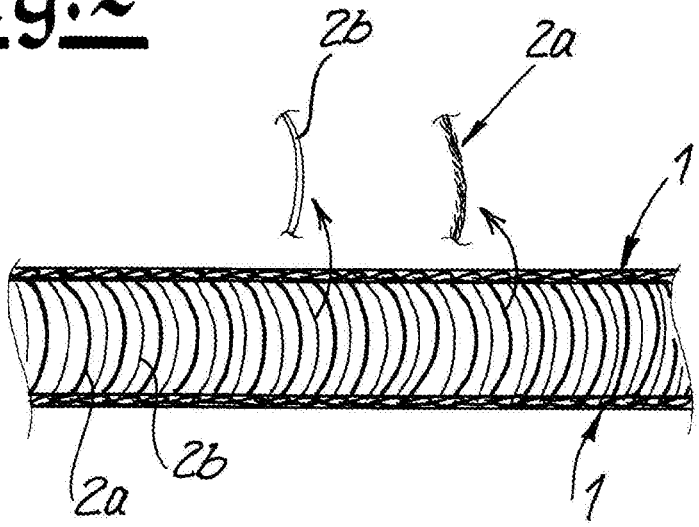
FIG. 2 is a large-scale edge view of the fabric.

It can be seen particularly in FIG. 2 that the second spacer yarns 2*b* are formed by polymeric monofilament yarn. By virtue of the polymeric monofilament yarn, good elastic properties are achieved that keep the two knitted layers 1 spaced apart from one another.

FIG. 1 shows how the preferably identically designed knitted layers 1 have openings 3 each formed by a plurality of stitches, thereby achieving an especially open and airy structure.

The metal braid can have between 5 and 15 individual strands, for example seven here, whose diameter is typically between 15 μm and 100 μm, for example about 70 μm. Especially preferably, the metal braid is formed by individual tinned copper wires, resulting in especially good heat conduction at comparatively low production costs. The sheath of tin makes it easy to solder the strands of copper. The polymeric monofilament yarn forming the second spacer yarns 2*b* can be polyester, particularly polyethylene terephthalate (PET), and usually has a diameter of between 50 μm and 300 μm.

The knitted spacer fabric illustrated in FIG. 1 is made by a total of six needle bars, namely two needle bars for the two knitted layers 1 and the spacer yarns 2*a* and 2*b*. The first spacer yarns 2*a* and the second spacer yarns 2*b* are therefore associated with different needle bars, so that full needle bars result in a ratio of the density of the spacer yarns 2*a* and 2*b* of 1:1.

The thickness of the knitted spacer fabric can for example be between 2 mm and 20 mm.

Figure 3:
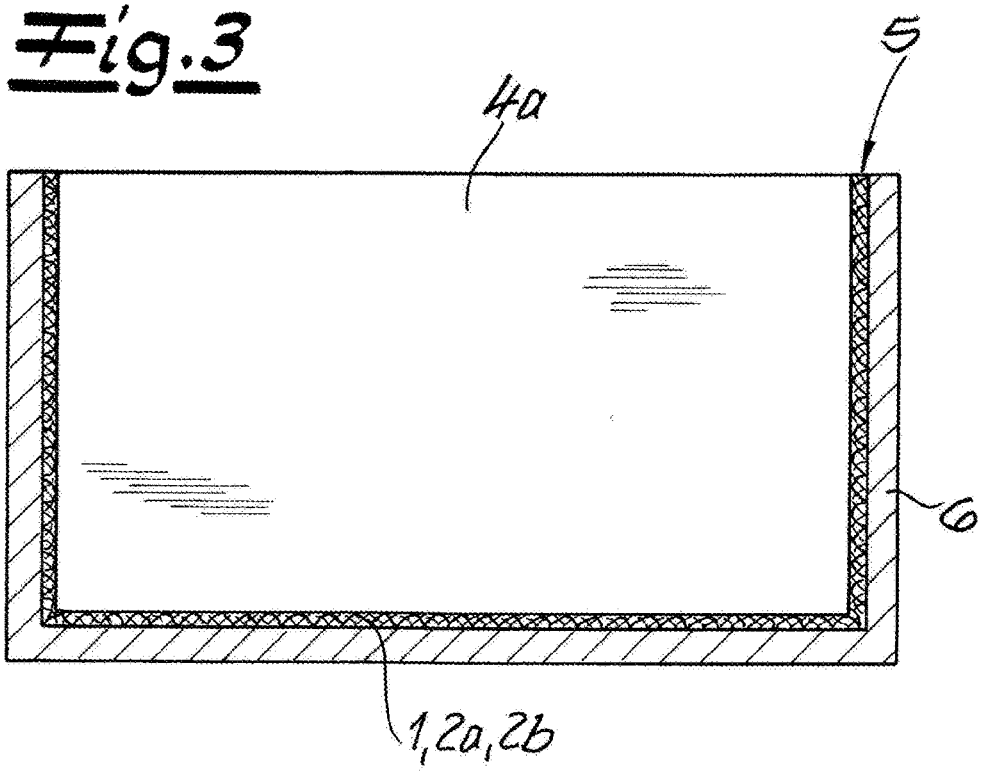
FIG. 3 is a vertical section through an assembly showing an application of the inventive spacer fabric.

FIG. 3 shows the use of the above-described knitted spacer fabric as a heat conduction layer fitted to an electrical component 4*a* for the purpose heat dissipation. Specifically, the somewhat transversely compressible knitted spacer fabric 1 is fitted in a thermally conductive manner in a gap 5 between a normally conductive housing wall 6 and the electrical component 4*a*, so that different gap dimensions can be thermally bridged. The electrical component 4*a* can be a rechargeable battery module, a motor, or the like.

Figure 4:
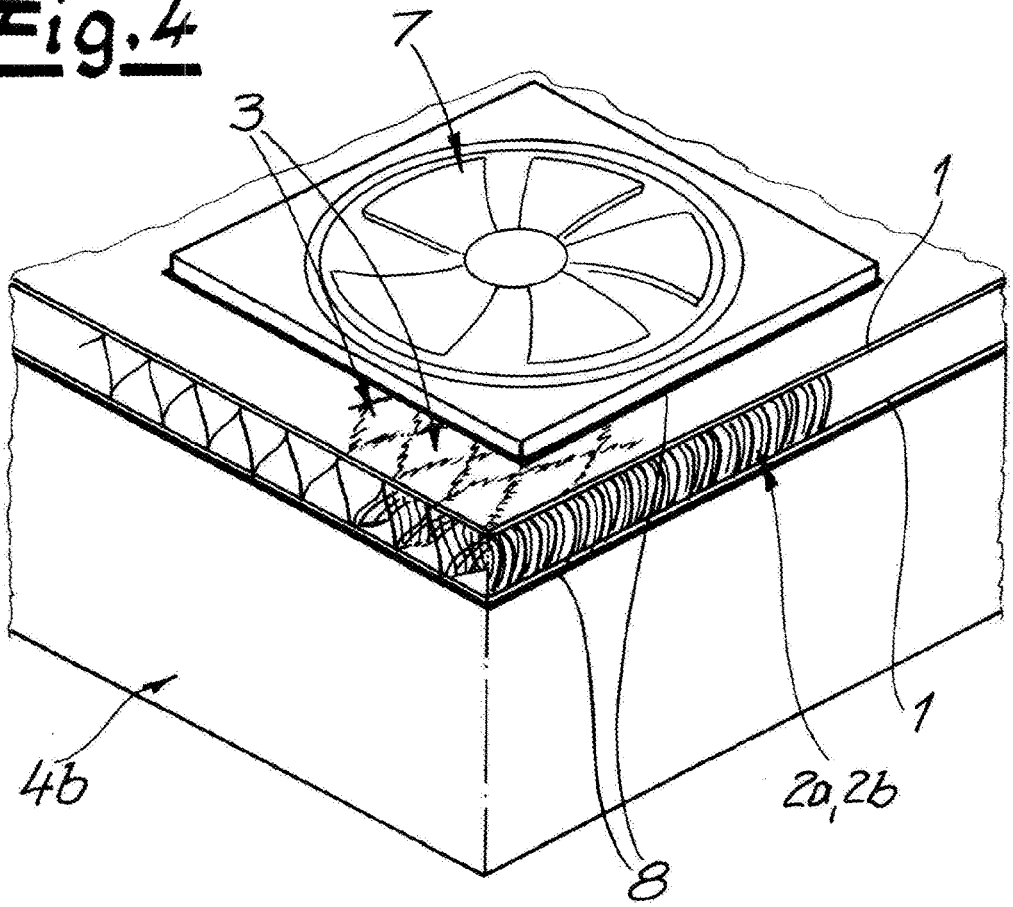
FIG. 4 is a perspective view of another application of the inventive spacer fabric.

FIG. 4 shows an alternative use of the knitted spacer fabric 1 according to the invention as a heat sink connected to an electronic component 4*b*. The knitted spacer fabric replaces largely massive, metallic heat sinks having ribs that are usually formed by injection molding or milling. In the illustrated embodiment, in order to flow air flow through knitted spacer fabric 1 as a heat sink, a fan 7 is provided that is mounted on the knitted spacer fabric 1 opposite the electronic component 4*b*. This then results in the additional advantage that the fan 7 is protected to a certain extent against shocks and impacts by the elastic properties of the knitted spacer fabric 1.

The knitted spacer fabric 1 is integrally bonded at 8 to the electrical component 4*b*. Adhesive, a thermal paste, or a metallic solder can be used as a the connecting means 8. This results in the advantage that, in the case of a configuration of the metal braid formed by tinned strands, soldering with metallic solder is easily possible, with an especially reliable and durable connection being achieved that is both thermally and electrically conductive.

We claim:

1. A knitted spacer fabric having:

two transversely spaced knitted layers each formed at least partially by metal-braid yarns; and first spacer yarns extending transversely between and connecting the knitted layers and formed by metal-braid yarns such that laminar and transverse electrical and thermal conduction is provided by the metal-braid yarns of the knitted layers and of the spacer yarns.

2. The improved knitted spacer fabric defined in claim 1, wherein both knitted layers are composed entirely of the metal-braid yarns.

3. The improved knitted spacer fabric defined in claim 1 wherein each of the metal-braid yarns is formed by tinned strands of copper or a copper alloy.

4. The improved knitted spacer fabric defined in claim 1, wherein each of the knitted layers on the one hand and the spacer yarns on the other hand are formed with two needle bars.

5. The improved knitted spacer fabric defined in claim 1, further comprising:

second spacer yarns formed by polymeric monofilament yarns.

6. The improved knitted spacer fabric defined in claim 5, wherein the monofilament yarns have a diameter of between 50 μm and 300 μm.

7. The improved knitted spacer fabric defined in claim 5, wherein the monofilament yarns are formed by polyester.

8. The improved knitted spacer fabric defined in claim 7, wherein the monofilament yarns are formed by polyethylene terephthalate.

9. The improved knitted spacer fabric defined in claim 1, wherein the metal-braid yarns forming each of the knitted layers and the first spacer filaments have between 5 and 15 strands each having a diameter of between 15 μm and 100 μm.

10. The improved knitted spacer fabric defined in claim 1, wherein the fabric has a thickness is between 2 mm and 20 mm.

11. The improved knitted spacer fabric defined in claim 1, wherein the fabric has a weight per unit area between 0.25 $kg/m^2$ and 2.5 $kg/m^2$.

12. Use of the knitted spacer fabric according to claim 1 as a heat conduction layer connected to an electrical component for heat removal.

13. The use defined in claim 12, wherein the knitted spacer fabric is arranged in a thermally conductive manner in a gap between a housing wall and the electrical component.

14. The use defined in claim 11, wherein the knitted spacer fabric is connected as a heat sink to an electronic component.

15. The use defined in claim 14, wherein fluid is flowed through the knitted spacer fabric.

16. The use defined in claim 15, wherein the fluid flow is effected by a fan.

17. The use defined in claim 11, wherein the knitted spacer fabric and the electrical component are integrally connected to one another.

* * * * *